United States Patent [19]

Webb

[11] 4,010,700

[45] Mar. 8, 1977

[54] PROGRAM CONTROLLED POWER TRANSMISSION

[75] Inventor: Harley E. Webb, Ooltewah, Tenn.

[73] Assignee: South-Co Machinery Company, Inc., Chattanooga, Tenn.

[22] Filed: Feb. 9, 1976

[21] Appl. No.: 656,589

[52] U.S. Cl. ..... 112/79 R; 74/218; 74/220; 112/220

[51] Int. Cl.[2] ..... D05C 15/02

[58] Field of Search ..... 112/79 R, 79 A, 78, 112/79 FF, 220, 221; 74/220, 218

[56] References Cited

UNITED STATES PATENTS

| | | | |
|---|---|---|---|
| 1,336,117 | 4/1920 | Wlodkowski | 74/220 |
| 1,665,974 | 4/1928 | Nycz | 74/218 X |
| 3,026,830 | 3/1962 | Bryant et al. | 112/79 R |
| 3,151,503 | 10/1964 | Keller et al. | 74/220 X |
| 3,502,044 | 3/1970 | Brown et al. | 112/79 R |

*Primary Examiner*—H. Hampton Hunter
*Attorney, Agent, or Firm*—Cushman, Darby & Cushman

[57] ABSTRACT

An apparatus for selectively delivering incremental linear motion to a reciprocably mounted tool of a machine, for example, the shifting needle bar of a carpet tufting machine, includes means for intermittently delivering rotary power to a set of oppositely rotatable shafts each having coupling means which, during each dwell period of power delivery, are coupled to driven shafts which are linked to rotate together in the same direction; program controlled latch means are provided for selectively operating one or the other of the coupling means to provide control of the direction and duration of the transmission of motion from the power source.

16 Claims, 6 Drawing Figures

PROGRAM CONTROLLED POWER TRANSMISSION

BACKGROUND AND BRIEF DESCRIPTION OF THE INVENTION

The present invention relates to power transmissions and, more particularly, to power transmissions that are program controlled so as to provide substantially enhanced flexibility in terms of control of a machine of the type that operates on a workpiece.

In a number of manufacturing operations, where a workpiece, which may be textile material, sheet material, such as metal, glass or plastic, or material handling apparatus, undergoes sequences of operations which may be repeated cyclically, a number of types of indexing mechanisms have been employed to move various mechanical elememts to carry out the sequence of operations on the workpiece. For example, in the carpet tufting field, it has been the practice to employ rotating cam surfaces to shift a needle bar to impress stitched patterns on a carpet backing. Likewise, in handling lumber and sheet metal, it is conventional to employ templates to carry out the function of guiding a tool through a series of mechanical motions to cut or otherwise form the workpiece, as desired.

In operations of the foregoing as well as other types, it has long been desired to expand the flexibility of the types of operations that can be effected by the work tool to correspondingly expand the variety of types of products that may be obtained thereby.

One manner of achieving this goal has been to resort to rather complicated and expensive modifications of existing machinery so as to render the machinery responsive to mechanically or electrically readable program sources such as magnetic or perforated tapes or the like. Thus, where the market demand has been such to justify the investments required to modify or construct such programmable devices, the versatility of operations that could be carried out has been limited only by the quantity and quality of intelligence that could be impressed on a program such as a magnetic or perforated tape or optically scannable medium. See, as examples, U.S. Pat. Nos. 3,502,044, 3,029,758 and 3,863,310.

While arrangements such as the foregoing are useful for their intended purposes, they suffer from the disadvantage that they in general require the wholesale replacement of existing equipment in order to take advantage of the flexibility and variety afforded by a program controlled work tool.

Is is an object of the present invention to provide power transmission apparatus, the output of which is readily controlled by a programmed source, yet which can be easily linked with an existing indexable tool. Additionally, the programmable power transmission of the present invention is capable of use in a wide variety of manufacturing applications where indexed tool operations are employed. Further, the apparatus of the present invention will afford all of the advantages attendant upon employment of a programmed source as the conrol medium for an indexable apparatus whether incorporated into existing machinery, or when forming the basis of entirely new manufacturing techniques.

To summarize the present invention, the apparatus includes a conventional indexing mechanism which converts continuous rotary power into intermittent rotary power which is continuously fed to oppositely rotating shafts. Dual coupling mechanisms are employed to transmit the output from one or the other of the rotating shafts to an output shaft. Selection of the coupling mechanism to be operated is preferably effected by solenoids which, in turn, are controlled by a program source such as a punched tape whereby the direction of rotation, period and, if desired, the speed of the output shaft is controlled by the program.

In a preferred embodiment, the output shaft is connected to a ball screw device which converts rotary motion to linear motion and the output of the ball screw device is connected to the shifting needle bar of a carpet tufting machine. With this arrangement, the number of patterns that can be formed in a tufted carpet can be made variable to an extent limited only by the capacity of the program. Also, the stitch pattern can be non-repeating along the length of the carpet which possibility was not available where cams or templates were used to obtain the shifting of the needle bar of the tufting machine.

The apparatus of the present invention can also be usefully employed with tools which work sheet material where the tool is translated laterally across the path of the material, for example, in cutting, stamping, folding operations or the like. Additionally, the apparatus of the present invention can be employed in sorting conveyed articles in a distribution facility where material, which may be either in liquid or solid form is to be passed from a source to a variety of work stations. Thus, for example, where containers are being fed from a storage facility to a variety of different filling machines having different capacities, the apparatus of the present invention can be employed to direct the required quantity of containers to selected machines according to a predetermined program. In this instance, the apparatus would function to divert the flow path of containers as is required.

The foregoing and other advantages and applications will become apparent as consideration is given to the following detail description of the invention and accompanying drawings, in which:

DETAILED DESCRIPTION OF THE INVENTION

Figure 1:
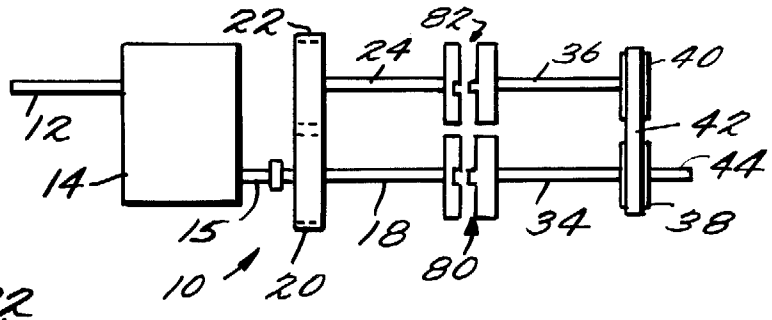
FIG. 1 is a schematic illustration of the power train of the apparatus of the present invention.

Referring now to FIG. 1, there is generally designated at 10 a schematic illustration of the power train of the apparatus of the present invention, which includes a drive shaft 12 which, when the apparatus is operated, is continuously driven by a power source such as an electric motor (now shown). The drive shaft 12 delivers rotary power in a selected direction to an indexing mechanism 14 which may comprise a conventional Geneva gear arrangement, or, more preferably, an index drive such as is disclosed in U.S. Pat. No. 3,572,173. The function of the indexing mechanism 14 is to convert the continuous rotary power delivered by drive shaft 12 to an intermittent rotary motion produced at output shaft 15. For example, for every 360° rotation of input shaft 12, output shaft 15 would be rotated 90°. Of course, it is evident that particular applications of the apparatus will require different ratios of input to output to satisfy the requirements of any particular application of the apparatus.

Output shaft 15 is directly coupled to a first rotary member which, in the illustrated embodiment in a shaft 18 which carries a spur gear 20 which intermeshes with another spur gear 22 mounted on a parallel second rotary member or shaft 24. At this point, it should be noted that it is not necessary that the ratio of spur gears 20 and 22 be equal as, in some applications of the apparatus of the present invention, it may be desirable that the ratios be different. However, it will simplify adjustment of the apparatus if the ratios are maintained as whole numbers.

The ends of the shaft 18 and 24 opposite the respective spur gears 20 and 22 are each provided with coupling means 80 and 82 to enable rotary motion from shafts 18 and 24 to be transmitted, respectively, to a third rotatable member such as shaft 34 and a fourth rotatable member such as shaft 36. As a simplifying factor, shafts 18 and 34 have their axes aligned along a common axis, while the same is true of shafts 24 and 36.

As will be explained in detail hereinafter, coupling means 80 and 82, while schematically illustrated in FIG. 1, have members which are movable with respect to their respective shaft elements to effect coupling of the first and third shafts 18 and 34 and second and fourth shafts 24 and 36. According to the present invention, means which are not illustrated in FIG. 1 are provided for preventing transmission of rotation through both sets of coupling means at the same time. The ends of shafts 34 and 36 opposite the coupling means 80 and 82, respectively, preferably interconnected by pairs of sprocket gears 38 and 40 connected by a sprocket chain 42, or by pulleys and a pulley belt so that shafts 34 and 36 will always rotate together in the same sense in either a clockwise or counter-clockwise direction. It should be noted that shafts 18 and 24, by virture of their spur gear interconnection, will be rotated in opposite directions relative to each other. The apparatus includes an output shaft 44 which, of course, may simply be an extension of shaft 34.

From the foregoing, it will be evident that when coupling means 80 is engaged, output shaft 44 will be rotated in the same direction and at the same speed as shaft 18 whereas, when coupling means 82 is engaged, output shaft 44 will be rotated in the opposite direction by virtue of the connection through sprocket chain 42, and sprocket gears 38 and 40 to shaft 36 which receives rotary power from shaft 24. The speed of rotation of the shaft 44 when coupling means 82 is engaged will be dependent on the gear ratio between spur gears 20 and 22 and the ratio between sprocket gears 38 and 40.

Figure 2:
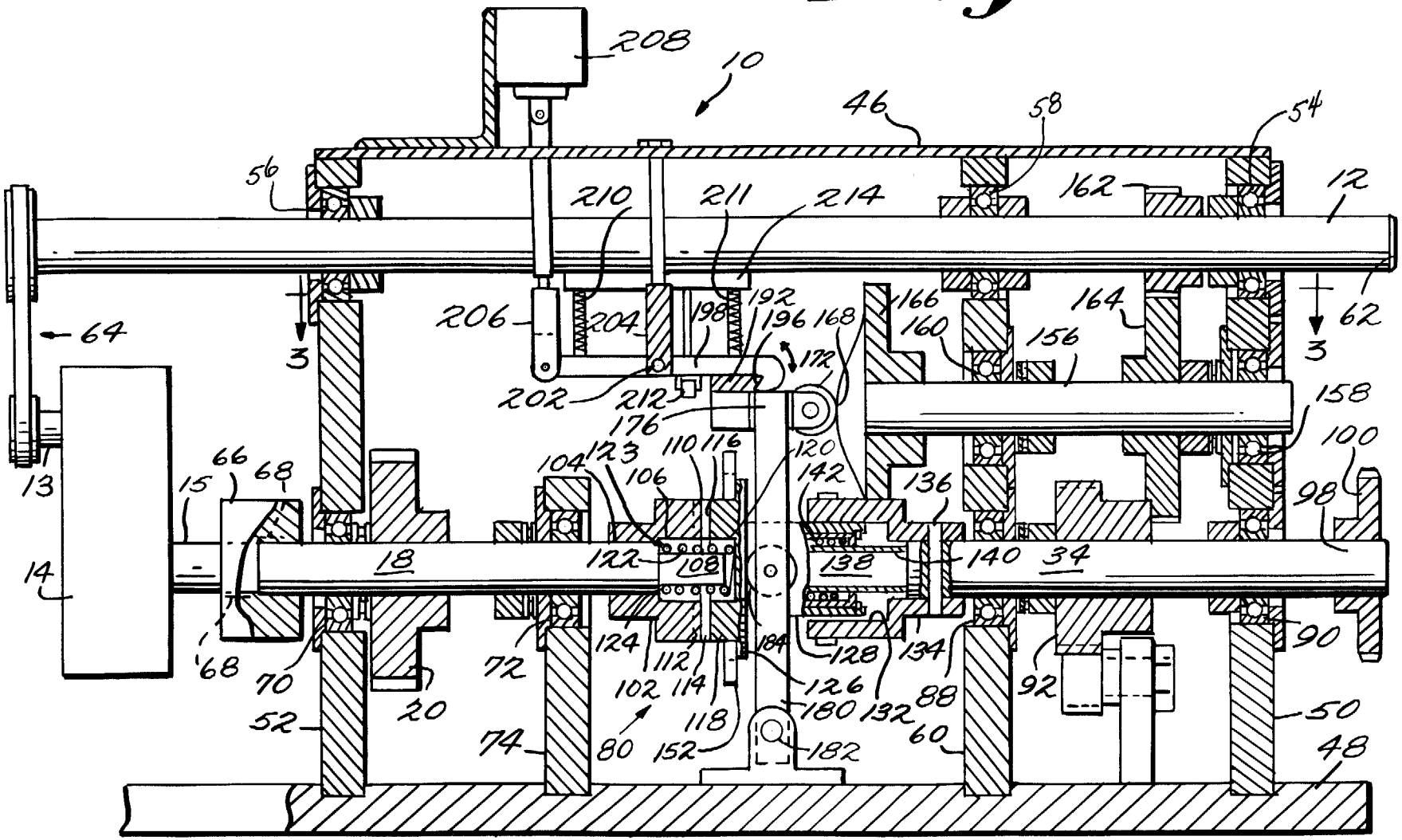
FIG. 2 is a sectional elevational view of a preferred embodiment of the apparatus of the present invention.

Referring now to FIG. 2, there is illustrated a convenient arrangement of the power train of the present invention as well as the coupling means and control means for the coupling means of the present invention. The same numerals used to designate schematically the elements of the present invention of FIG. 1 will be used in the remaining figures of the drawing to facilitate an understanding of the present invention.

In the arrangement of FIG. 2, the power input shaft 12 is mounted to extend along the upper portion of a housing 46 which includes a base 48 and end walls 50 and 52. The input shaft 12 is supported as is conventional in bearings 54 and 56 in end walls 50 and 52, respectively, and at an intermediate point by bearing 58 located in an intermediate support wall 60 within housing 46.

As previously noted, drive shaft 12 is connected at its end 62 to a power source such as an electric motor preferably by means of a sprocket gear (not shown) which would be mounted on the end 62 of shaft 12 and connected by a chain to the output of the electric motor. Thus, shaft 12 would be continuously driven about its longitudinal axis in one direction, for example, counter-clockwise when viewed from the right side of FIG. 2. The other end of the shaft 12 is connected by a pulley and belt 64 so as to provide a continuous rotary power to an input shaft 13 to an indexing drive 14 which, as noted above, may be a conventional Geneva gear drive or the indexing drive as described in U.S. Pat. No. 3,572,173.

Indexing drive 14 should be selected so that its rotary output at shaft 15 can be varied to meet the operational requirements of the manufacturing procedures in which the apparatus of the present invention is employed. For illustrative purposes, let it be assumed that for every 360° rotation of the input shaft 13 of index drive 14, rotary output shaft 15 will be rotated 90°. Thus, there will be a dwell period where shaft 15 will not be rotating, the duration of which is dependent on the speed of rotation of the input shaft 12. Of course, the speed of rotation of output shaft 15 will also be dependent on the gear ratio of the elements within the indexing drive 14, as is conventional.

Shaft 15 is directly coupled to a first rotary member of the apparatus of the present invention which is shaft 18. Any conventional coupling mechanism may be employed such as the illustrated interiorly slotted cylinder 66, the slots of which interfit with splines on the ends of shafts 15 and 18, as at 68.

Figure 3:
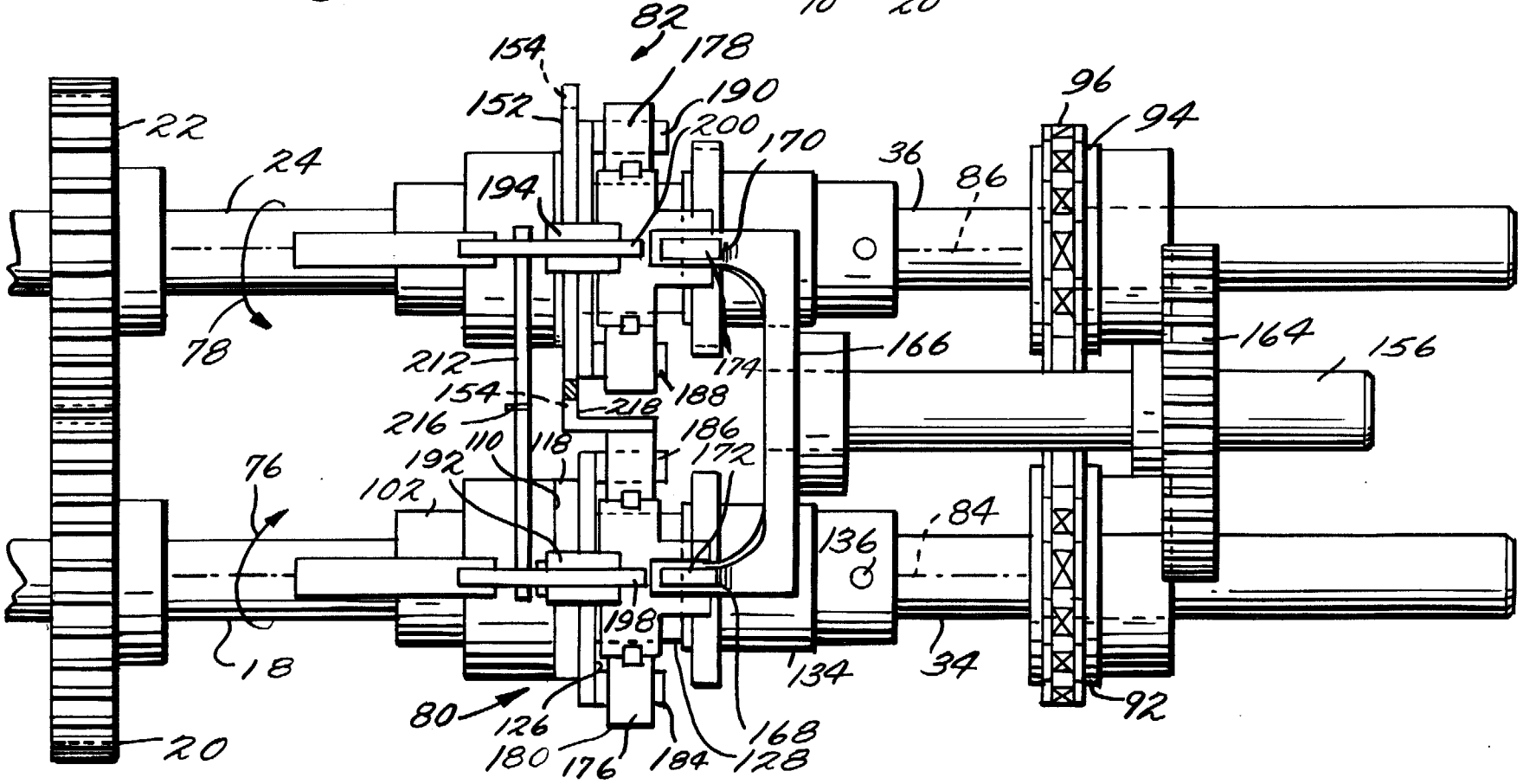
FIG. 3 is a view taken along lines 3—3 of FIG. 2.

Shaft 18 extends through a journal bearing 70 mounted in an opening in wall 52 and is supported intermediate its ends in bearing 72 mounted in a support panel 74 located on the interior of housing 46. Preferably, the longitudinal axis of shaft 18 is aligned with the axis of shaft 15. As shown more clearly in FIG. 3, a parallel shaft 24 is mounted in housing 46 in a manner similar to that as shaft 18. Means in the form of spur gears 20, which is mounted on shaft 18, and 22, which is mounted on shaft 24, serve to interconnect shafts 18 and 24 so that the shafts will be rotated in opposite directions as indicated by the arrows 76 and 78. The support walls and bearings for the shafts in FIG. 3 are deleted for the sake of clarity, but it will be understood that such supports may be identical to that as illustrated in FIG. 2, for shaft 18.

In certain applications, it is desirable that the ratio between gears 20 and 22 be equal, where in other applications of the apparatus of the present invention, it may be desirable that these ratios be on a higher or lower order to accommodate, as previously discussed, specific manufacturing applications. For illustrative purposes, let it be assumed that the ratios between gears 20 and 22 is 1:1.

At the ends of shafts 18 and 24, remote from the wall 52, are elements of the coupling means 80 and 82 of the present invention, the details and operation of which will be explained hereinafter. In general, however, the coupling means 80 serves to couple shaft 18 to another rotary member which, in the illustrated embodiment, is shaft 34, while the coupling means 82 serves to connect shaft 24 to a fourth rotary member, namely, shaft 36 (FIG. 3). Shafts 18 and 34, as well as shafts 24 and 36, are each aligned along common, parallel extending axes indicated at 84 and 86, respectively.

Again referring to FIG. 2, it will be seen that shaft 34 is supported in journal bearings 88 located in an aperture formed in wall 60 as well as by journal bearing 90 disposed in an aperture in end wall 50. Similar rotational supports (not shown) are provided in walls 60 and 50 for shaft 36.

Between walls 50 and 60, sprocket gears 92 and 94 are fixedly mounted, respectively, on shafts 34 and 36 and a chain 96 (FIG. 3) is tightly wrapped around the teeth of the sprocket gears 92 and 94 so that upon rotation of one of the shafts, 34 or 36, the other shaft will be rotated at the same speed and in the same direction where the sprocket gears 92 and 94 have a 1:1 gear ratio. As noted above, however, there will be some applications of the apparatus of the present invention where other gear ratios will be useful.

The end 98 of shaft 34 may be selected as an output shaft of the apparatus 10 and, to this end, a sprocket gear 100 may be fixed on the end of shaft 34. It will be apparent to those skilled in the art, however, that shaft 36 will equally perform the function as the output shaft of the apparatus 10 instead of shaft 34 as the selection between these shafts is arbitrary in this regard.

The coupling means for the two pairs, 18 and 34, and 24 and 26, of rotatable shafts will now be described with respect to the coupling means 80 for shafts 18 and 34, it being understood that coupling means 82 for shafts 24 and 36 is identical with respect to the disposition and function of its elements with one difference which will be described hereinafter.

Coupling means 80 is essentially a clutch mechanism comprising a collar member 102 which is fixed on shaft 18 to be rotatable therewith adjacent the end of shaft 18. In this embodiment, collar member 102 has a bore 104 which fits over the exterior circumference of the shaft 18 and a counter bore 106 which has a slightly larger diameter than that of bore 104. The end of shaft 18 is provided with a reduced diameter portion 108 which extends beyond the face 110 of collar 102. As shown, the face 110 is substantially planar and extends perpendicularly to the longitudinal axis of the shaft 18. Further, as more clearly shown in FIG. 4, face 110 has four radially extending slots 112 each for cooperating with raised teeth 114 formed on a parallel extending face 116 of coupling member 118.

Coupling member 118 has at its center a circular bore 120 which has a diameter sufficient to accommodate portion 108 as well as coil spring 122 which is housed in counter bore 106 and is seated at one end on thrust bearing 123 seated on land 124 of shaft 18. The outer end of coil spring 122 seats on the end wall of chamber 120.

Coupling member 118 is formed with an annular contact surface 126 which extends parallel to, but faces in an opposite direction from the face 116. From contact surface 126, there axially projects a hollow tubular extension 128 which, at its free end, has an enlarged head 146 which serves as a power transmission member and which is disposed in a slotted bore 132 of collar 134. Collar 134 is pinned to the end of shaft 34 as at 136.

Shaft 34 has a reduced diameter extension 138 similar to portion 108 of shaft 18, but on which is fitted a cylindrical bushing 140. Housed between the bushing 140 and the interior of the tubular extension 128 are anti-friction means such as ball bearings 142 provided for the purpose of facilitating sliding movement between coupling member 118 and collar 134.

Figure 4:
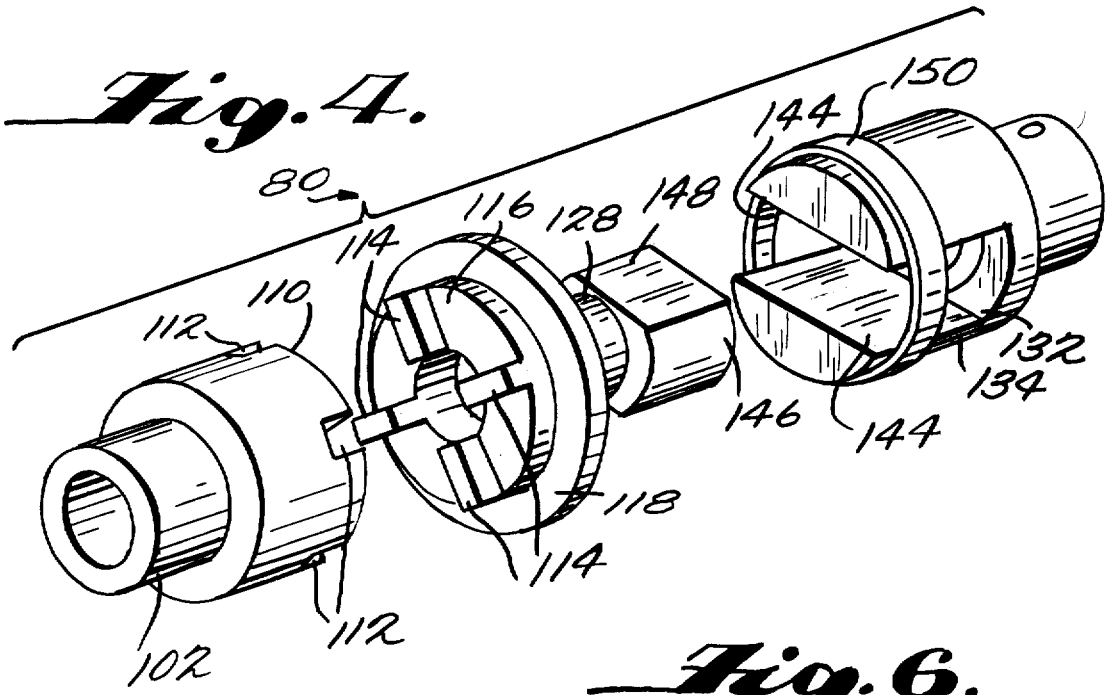
FIG. 4 is a detailed view of the coupling means of the present invention.

As seen more clearly in FIG. 4, collar 134 has in bore 132 flat portions 144 which are surfaces that lie along chords of the circumference of the bore 132. As noted previously, the end of the tubular extension 128 of coupling member 118 has an enlarged head 146 which, on opposite sides, has flat surfaces 148, the perpendicular distance between which is equal to the distance between flat surfaces 144 of collar 134. Also, the axial length of the enlarged head 146 is large enough relative to the depth of the bore 132 so that, when the enlarged head 146 is shifted axially relative collar 134, the flat surfaces 148 will remain in engagement with the surfaces 144. Thus, when the coupling member 118 is shifted to the left as viewed in FIG. 2, by means to be described, the flat surfaces 148 of enlarged head 146 will remain sufficiently in parallel contact with the flat surfaces 144 of collar 134 to thereby transmit rotary motion from the coupling member 118 to the collar 134 and thus, to shaft 34.

For manufacturing convenience, collar 134 has portions of its side walls removed as shown in FIG. 4 and a ring 150 is secured as by welding around the free end of the collar 134 in order to provide structural support to the collar that is lost by virtue of the removal of portions of the side walls.

As noted previously, the coupling means 82 is identical to coupling means 80 except for one difference which is the provision of an annular flange 152 (see FIG. 3) which is provided with angularly spaced apart slots 154 extending radially therein. Annular flange 152 may be secured by any suitable means such as welding or by bolting to the projected surface corresponding to surface 126 provided on the clutch member corresponding to clutch member 118 of coupling means 80.

The means for effecting coupling of the coupling means 80 and 82 will now be described.

As shown in FIG. 2, a driven shaft 156 is rotatably mounted on bearings 158 in wall 50 and bearings 160 in wall 60. Shaft 156 extends parallel to drive shaft 12 and receives rotary power from shaft 12 by spur gear 162 mounted on shaft 12 and spur gear 164 mounted on shaft 156. At its interior end, there is mounted on shaft 156 a disc member 16 which, on its inner face, as shown more clearly in FIG. 3, has two cam surfaces 168 and 179 which are in the form of raised axially extending lobes located 180° apart in this embodiment on disc member 166. Cam followers are provided in the form of rollers 172 and 174 which are each rotatably mounted on U-shaped yokes 176 and 178, respectively. As shown more clearly in FIG. 2, for yoke 176, each leg 180 of each yoke is pivotally mounted as at 182 on the base 48 of the housing 46.

Approximately midway along the length of each leg of each yoke there is rotatably mounted a roller such as at 184 and 186 for yoke 176 and at 188 and 190 for yoke 178. As will be subsequently explained in detail, each of the rollers is maintained in continuous contact with the contact surface 126 of its associated clutch member 118.

Secured to the crosspiece of each yoke, approximately at their midpoints, are latch engaging means in the form of blocks 192 on yoke 176 and 194 on yoke 178. As more clearly shown in FIG. 2, the front face of each block is slanted inwardly as at 196.

Means for retaining the coupling means 80 and 82 in their coupled positions are provided in the form of latches 198 and 200, each of which is pivotally mounted as at 202 on a support member 204 which is securely suspended from the top of housing 46 or otherwise suitably mounted with the housing 46.

Opposite the hooked end of each latch 198 and 200, there is pivotally connected an arm shown in FIG. 2 at 206 which is adjustably connected to a solenoid 208 which, when electrically energized by a current draws the arm 206 into the solenoid, thus pivoting latch 198 clockwise about pivot 202 so that the hooked portion will engage surface 196 of the block 192. Pairs of springs as at 210 and 211 may be provided so that when the solenoid 208 is deenergized, the weight of arm 206 serves to pivot the latch 198 counter-clockwise out of engagement with the block 192 against the force of spring 211. Preferably, solenoid 208 will be actuated at a time sufficient to bring the hook of latch 198 into contact with the top of block 192 so that when the cam surface 168 pushes the yoke 176 to a position where the hook of latch 198 clears the end of block 192, spring 211 will snap the latch into engagement with the slanted surface 196. The disposition of the solenoid 268 (FIG. 6) and pivot arms for latch 200 are identical to that as shown for latch 198 and, therefore, need not be described.

According to the present invention, a mechanical safety feature is provided in the form of a pivotably mounted crossbar 212, which is pivotably suspended from platform 214, and extends underneath and contacts both of the latches 198 and 200. As shown in FIG. 3, the pivot point for crossbar 212 is located intermediate its ends as at 216 so that when one of the latches is moved downwardly or clockwise as viewed in FIG. 2, the opposite end of the crossbar will move upwardly to assure that the other latch will be maintained out of engagement with its associated block.

A description of the operation of the apparatus of the present invention, as thus far described, will now be given.

With reference to coupling means 80 of FIG. 2, coil spring 122 is constantly applying force to clutch member 118 tending to shift clutch member 118 to its disengaged position, i.e., to the right as viewed in FIG. 2 so that the key means in the form of the teeth 114 will also be urged out of the recesses 112 in collar 102. Additionally, the spring force exerted on clutch member 118 will always maintain contact surface 126 in engagement with parallel rollers 184 and 186. In addition, rollers 172 and 174 on yokes 176 and 178, respectively, will be continuously maintained in contact with the face of disc 166.

Since, in operation, drive shaft 12 is continuously rotated at constant speed, rotary power will be continually supplied through spur gear 164 to shaft 156 which thereby continuously rotates disc 166 at a constant speed. As a result, as the diametrically disposed cam surfaces 168 and 170 come into contact with the rollers 172 and 174, these rollers and their mounting yokes 176 and 178 will be pivoted in a counter-clockwise direction as viewed in FIG. 2 a distance equal to the height of the cam surfaces 168 and 170 against the force of spring 122 and the corresponding spring in coupling means 82 to thus bring the teeth of clutch member 118 into engagement with the recesses 112 in collar 102 which is the coupled position of the coupling means 80 which also corresponds to the coupling position of the coupling means 82.

If the solenoid 208 and the corresponding solenoid for latch 200 remain de-energized as the cam surfaces 168 and 170 move the coupling means to their coupled positions, as soon as the cam surfaces move past the respective rollers 172 and 174, the coil springs as at 122 will urge the clutch members as at 118 from the key means engaged positions to their key means disengaged positions with respect to collars 102 and 134, simultaneously.

According to the present invention, the speed of rotation of the cam disc 166 should be in timed relationship with the output of the indexing mechanism 14, which is achieved by a proper selection of the gear ratio between spur gears 162 and 164 so that movement of the coupling means 80 and 82 to their coupled positions, as described above, will occur only during the dwell period of indexing mechanism 14, that is, when no rotary motion is being transmitted by indexing mechanism 14 through shaft 15 to shaft 18. In other words, coupling means 80 and 82 will be moved to their coupled positions only at those intervals when none of the shafts 15, 18, 24, 34 and 36 is being subjected to rotary motion.

As previously described in connection with FIG. 1, the direction of rotation of the shaft 34 and, therefore, the output shaft 44 is determined on the basis of which of the two coupling means, 80 or 82, is in its coupled position. Thus, it will be appreciated, that by selectively operating either the solenoid for coupling means 80 or the solenoid for coupling means 82, the direction of rotation of the output shaft 34 can be readily selected as well as the time period of the intermittent rotation in the selected direction by simply maintaining the selected coupling means in its engaged or coupled position corresponding to the condition where the associated solenoid is being energized by an electric current or energized at least during and subsequent to the interval when the cam surfaces 168 and 170 are in contact with the rollers 172 and 174.

To facilitate disengagement of the latches 198 and 200 from the blocks 192 and 194, the height of the cam surfaces 168 and 170 may be sufficient to push the yokes 176 and 178 to the left as reviewed in FIG. 2 so that the hooked portions of the latches will clear the slanted surfaces 196.

From a consideration of the foregoing, it will be readily understood by those skilled in the art that the maintaining of both of the coupling means 80 and 82 in their coupled positions at the end of a dwell period of the indexing mechanism 14 must be avoided in order to prevent damage to the sprocket gears 92 and 96 and the chain 94, as well as to the coupling means themselves. In addition to the safety afforded by the crossbar 212, another back-up safety device of the present invention is illustrated in FIG. 3 and includes a bent pin 218 which is welded or otherwise securely fixed to the inside leg of yoke 176 at a height such that when both of the coupling means are moved to their uncoupled positions by the cam surfaces 168 and 170, the pin 218 will fit into a slot 154 on the annular flange 152 of coupling means 82 to thereby prevent any accidental rotation occurring while both of the coupling means are in their uncoupled position. This feature is chiefly provided to prevent motion from being transferred back from the operated machinery through the normally freely rotatable shafts 34 and 36 to the coupling means.

Figure 5:
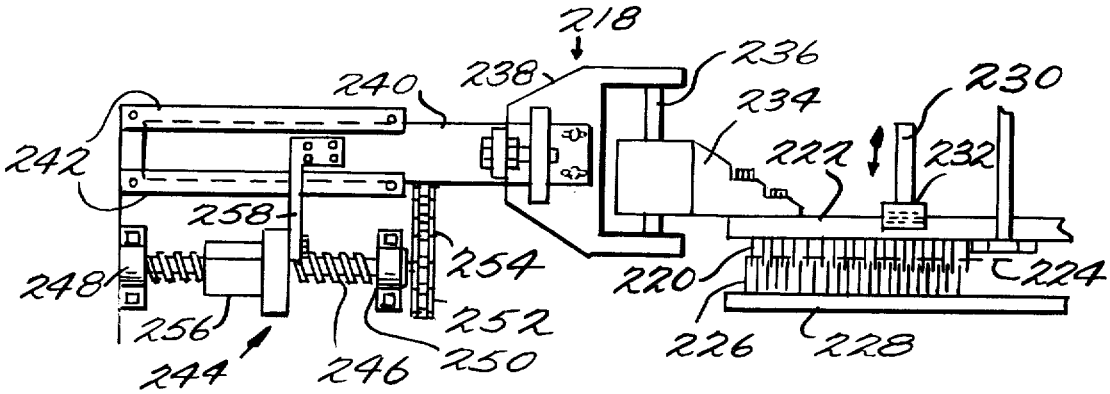
FIG. 5 is an illustration of the application of the present invention to a carpet tufting machine.

The apparatus of the present invention is particularly useful in combination with the shifting needle bar of a carpet tufting machine such as is illustrated in FIG. 5, the basic elements and operation of which is described in U.S. Pat. No. 3,026,830 of Mar. 27, 1962.

The operation of the carpet tufting machine 218 of FIG. 5 is intended to produce checkered, stepped, striped or other similar patterns in a carpet. To this end, a plurality of needles 220 are mounted on an arm 222 which extends transverse to a carpet backing sheet indicated by the broken line 224. Yarn loopers 226 are mounted on a support 228 disposed on the opposite side of the carpet backing sheet 224 and serve to hold the loops formed by the needles 220 when the arm 222 is reciprocated by the operating arm 230 along a predetermined path which extends perpendicular to the direction of travel of the carpet backing 224. Operating arm 230 has a head 232 which is slidably mounted on flanges on arm 222. At one end of arm 222 a bracket arm 234 is secured which, in turn, is slidably mounted on a post 236 which extends between the arms of a support yoke 238. Support yoke 238 is securely fixed to a slide beam 240 which is slidably mounted in guide bars 242.

As is conventional in the tufting art, the yarns that are supplied to the various needles 220 may be of different colors and/or textures. Thus, as the carpet backing 224 moves under the needles 220 each needle will form a row of loops upon reciprocation of the operating arm 230. However, upon shifting of the slide beam 240 to the right or left as viewed in FIG. 5, a selected distance or distances, a variety of patterns can be formed on the carpet backing sheet 234.

The apparatus of the present invention, as previously noted, is particularly adapted to effect shifting of the slide beam 240 is a manner controlled by a program so as to substantially increase the variety of types of patterns that can be formed in the carpet. To this end, it is necessary to convert the rotary motion of the output shaft 34 of the apparatus of the present invention to linear motion. This is achieved by the use of conversion means 244 which may be a ball screw device which includes a screw member 246 which at its opposite ends is rotatably mounted in bearing means 248 and 250. One end of the screw member 246 is provided with a sprocket gear 252 which receives rotary power by a chain 254 which is connected to the sprocket gear 100 located on the end 98 of shaft 34 (FIG. 2). A housing 256 is mounted on screw 246 and contains ball-bearings which are in engagement with the threads of screw member 246. Thus, rotation of the screw member 246 will effect linear translation of the housing 256. The housing 256 is securely attached as by an arm 258 to the slide beam 240.

With the apparatus 10 of the present invention and the carpet tufting machine 218, FIG. 5, arranged as described above, it will be seen that when coupling means 80 (FIG. 2) is held in its coupled position by latch 98 which is operated by its solenoid 208, the intermittent rotation of shaft 34 will effect intermittent rotation of the screw member 246 thus causing intermittent shifting of the slide beam 240 which is directly transmitted to needle arm 222. When solenoid 208 is deactivated and the solenoid for latch 200 activated, coupling means 82 will be retained in its coupled position causing shaft 36 to govern the rotation of shaft 34, namely, in the opposite direction which will effect the shifting of slide beam 240 in an opposite direction, thus altering the pattern of the yarns in the carpet backing 224.

It will be apparent that in place of the solenoids, the control arms such as at 206 for the latches 198 and 200 may be connected directly to eccentric wheels or, if desired, controlled by cams where a very limited repeating pattern is desired in the carpet product. Similarly, other mechanical means such as cams can be employed to impart motion to the arm 206 for latch 198 and the other arm for latch 200.

Figure 6:
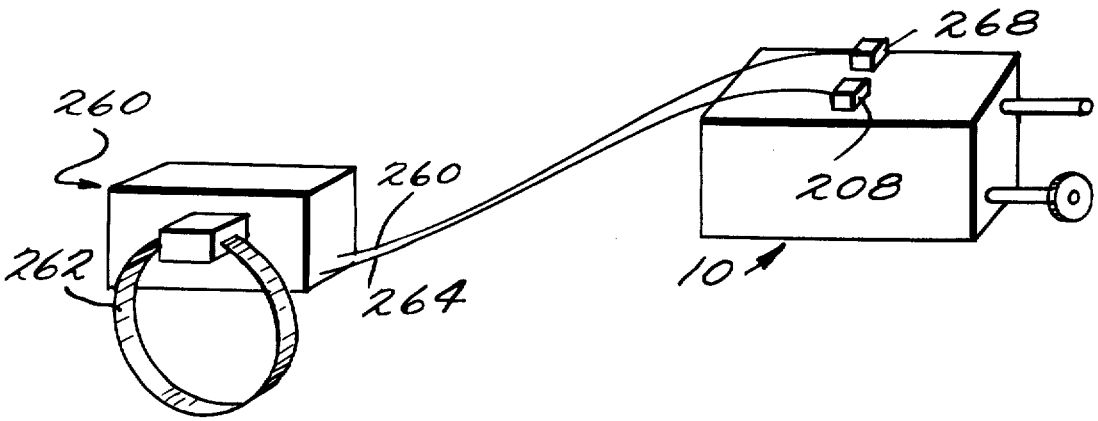
FIG. 6 is an illustration of one embodiment of a program source for the apparatus of the present invention.

A very advantageous system for controlling the operation of the solenoids of the apparatus 10 of the present invention is illustrated in FIG. 6. It includes a tape reader 260 which senses perforations formed in a tape 262 and delivers current through wires 264 and 266 to solenoids 208 for couplings means 80 and solenoid 268 for coupling means 82. The perforations on the tape 262 constitute a program source which will be reflected in the pattern formed in the carpet backing 224. The simplest type of program consists of two columns or paths of perforations corresponding to the two solenoids 208 and 268. Two reading heads would be provided in reader 260 for sensing the perforations in each path on the tape 262. For example, one perforation in one column would supply a signal to control a circuit so that current will be delivered to solenoid 208 until no perforation in the same column or path is sensed which would alter the circuit and cut off current to the solenoid 208. Thus, the number of perforations in one column or path on the tape 262 would be directly reflected in the amount of shift in the pattern from a straight line set of stitches. The perforations must, of course, be placed in the tape so that at no time are both solenoids energized for the reasons set forth previously. Additionally, an and/or circuit may be employed in the tape reader to assure that current is never delivered to both of the solenoids simultaneously. The tape reader 260 may be any of the conventional type currently available on the market which either employes photosensitive cells to detect the perforations or energized contact switches or the like.

It will be appreciated that the indexing mechanism 14 employed in the apparatus of the present invention will be adjusted to deliver rotary power to the output shaft 34 in timed relationship with the stitching stroke of the operating arm 230. That is to say, when the stitching arm 230 is being operated, the output of the indexing mechanism 14 will be in its dwell mode at least until the operating arm 230 moves to its retracted position wherein the needles 220 are disengaged and are capable of being shifted transversely with respect to the carpet backing 224.

It will also be appreciated that the solenoids 208 and 268 of the apparatus of the present invention can be supplied with current through manual switches, if desired, which would be desirable where discretion is required by the operator in handling a workpiece.

One of the chief advantages of the apparatus of the present invention is the elimination of the necessity of repeatedly intermeshing gears to effect control of the direction of rotation of an output power shaft, as well as the elimination of hydraulic transmission means to obtain reversal of the direction of the rotation of a member. Thus, with the apparatus of the present invention, extremely high speed operations can be employed since the danger of stripping control gears is avoided.

According to another embodiment of the present invention, in place of the latches 198 and 200, magnetic means may be employed to selectively maintain the coupling means 80 and 82 in their coupled positions once the respective yokes 176 and 178 are moved to engage the clutch members. In some applications of the apparatus of the present invention, both the yokes and the latches may be substituted by magnetic clutches that are electrically actuated. However, due to the inherent slippage that occurs upon initial operation of such devices, such arrangements are less preferred where precisely timed transmission of rotary power is required.

While the foregoing has been a description of the preferred embodiment of the present invention, it will be obvious to those skilled in this art that various modifications may be made therein without departing from the spirit and scope of the present invention as defined in the appended claims.

What is claimed is:

1. An apparatus for controlling a driven rotatable member simultaneously with respect to its direction of rotation and the period of rotation in a selected direction comprising:

drive means for continuously delivering rotary power at a selected speed, transmission means for receiving said rotary power from said drive means and transmitting intermittently said rotary power in selected increments of rotation in a selected direction, a first rotatable member connected to said transmission means for rotation thereby.

a second rotatable member, means connecting said first and second rotatable members for rotation in opposite directions, a third and a fourth member each mounted for rotation in either a clockwise or a counter-clockwise direction, first coupling means for coupling said first and third members so that rotation of said first member will be transmitted to said third member, second coupling means for coupling said second and fourth members so that rotation of said second member will be transmitted to said fourth member, said first and second coupling means each being movable independently of each other between a coupled and an uncoupled position relative to said first and third and said second and fourth members, respectively, said first and said second coupling means each having biasing means for constantly urging said respective coupling means toward said uncoupled positions, means for moving said first and second coupling means to said coupled positions against the urging of said biasing means in timed relationship with said transmission means so that said first and second coupling means will both be in said coupled positions only when no rotary power is being transmitted by said transmission means to said first rotatable member, retaining means for holding said first and second coupling means in said coupled positions, said retaining means being selectively operable so that, while one of said coupling means is held in said coupled position, said other coupling means will be free to move under the urging of said biasing means to said uncoupled position, and means for connecting said third and fourth rotatable members for rotation in the same direction so that, when said first coupling means is held in said coupled position, said third rotatable member will be rotated in the same direction as said first rotatable member and, when said second coupling means is held in said coupled position, said third rotatable member will be rotated in the same direction as said second rotatable member.

2. The apparatus as claimed in claim 1 wherein said means for moving said first and second coupling means toward said coupled positions includes at least two cam surfaces disposed on a rotatable disc at a selected angular relationship, a first movable cam surface engaging means associated with said first coupling means, a second movable cam surface engaging means associated with said coupling means so that, upon rotation of said disc, said cam surfaces will substantially simultaneously impart movement to said cam surface engaging means to thereby substantially simultaneously move said first and second coupling means to said coupled positions.

3. The apparatus as claimed in claim 2 wherein each of said cam surface engaging means includes means engageable by said retaining means when said respective coupling means are in said coupled positions.

4. The apparatus as claimed in claim 1 wherein said first and second coupling means include a collar means fixedly disposed on said first and on said second rotatable members, each said collar means having a plurality of recesses, said third and fourth rotatable members each having a collar means fixedly disposed thereon, each said collar means of said third and fourth members having a power transmitting portion, said first and second coupling means each further including a movable clutch member, each said clutch member having first key means for engaging at least one of said recesses in an associated with said collar means of said first and second rotatable members, each said clutch member having second key means in engagement with said power transmitting portions of said collar means of said third and fourth members, each said clutch member being movable between a first key means engaging position and a first key means disengaged position corresponding to said coupled and uncoupled positions, respectively.

5. The apparatus as claimed in claim 4 wherein said biasing means comprises spring means disposed between each said collar means of said first and second rotatable members and each said clutch member to constantly urge said clutch members toward said respective key means disengaged positions.

6. The apparatus as claimed in claim 5 wherein each said clutch member is provided with a contact surface facing generally toward said respective collar means of said third and fourth rotatable members and said means for moving said clutch members from said key means disengaged positions to said key means engaged positions comprises a rotatable disc having spaced apart cam surfaces, a cam follower for each said clutch member, movable mounting means for each said cam follower, each said mounting means having a portion in engagement with a said contact surface of a said clutch member so that, upon movement of said mounting means in response to engagement of said cam followers with said cam surfaces, said clutch members will be moved to said key means engaged positions.

7. The apparatus as claimed in claim 6 wherein each said movable mounting means includes a portion engageable by said retaining means and said retaining means includes a first latch for said first coupling means and a second latch for said second coupling means, said latches each being pivotable about an axis between a latched position, wherein a said respective portion on a said associated mounting means is engaged thereby, and an unlatched position, said retaining means further including means for moving one of said latches to its unlatched position when said other latch is moved to its latched position so that both of said latches will not simultaneously occupy said respective latched positions.

8. The apparatus as claimed in claim 7 wherein said retaining means further includes a first electrically energizable solenoid means connected to said first latch and a second electrically energizable solenoid means connected to said second latch for moving said respective latches from said unlatched to said latched positions when said respective solenoid means are energized by an electric current and returning means for each said latch for moving each said latch to said unlatched position when said respective solenoid means are not energized by an electric current.

9. The apparatus as claimed in claim 1 further including conversion means for converting rotary motion to linear motion, said conversion means being connected to said third rotatable member for receiving rotary motion therefrom.

10. The apparatus as claimed in claim 9 in combination with a tufting machine having needle-operating means disposed for reciprocation in a predetermined path, a plurality of needles carried by said needle-operating means, a mounting member for said plurality of needles, said mounting member being movable in a direction that is a substantially perpendicular to said predetermined path, means linking said mounting member to said conversion means so that rotary motion of said third rotatable member will be transmitted as linear motion to said mounting member by said conversion means.

11. The apparatus as claimed in claim 10 wherein said conversion means comprises a rotatably mounted screw, said screw being connected to said third rotatable member so as to be rotatable therewith in the same direction as said third rotatable member is rotated, a housing mounted on said screw, said housing having antifriction means engaging said screw so that, upon rotation of said screw, said housing will be translated linearly along said screw, said housing being fixedly connected to said mounting member so that rotation of said third rotatable member in one direction will effect linear movement of said mounting member in a corresponding direction while rotation of said third rotatable member in an opposite direction will effect linear movement of said mounting member in a reverse direction.

12. The apparatus as claimed in claim 4 wherein said first, second, third and fourth rotatable members are, respectively, first, second, third and fourth shafts mounted to be rotatable about their longitudinal axes with the axes of said first and third shafts being substantially along a common axis and with the axes of said second and fourth shafts being substantially aligned along another common axis which extends substantially parallel to said first mentioned common axis, said collar means on said first and on said second rotatable members each comprising a collar having a through bore, said first and second shafts each having one end fixed in a said collar adjacent an end of said bore, said first and second shafts each having a reduced diameter portion at least partially disposed in said respective bores which, with bores, define annular chambers, said biasing means comprising a coil spring disposed in each said chamber with one end of each coil spring engaging said respective first and second shafts and the other end of each coil spring engaging a said clutch member, said collars each having a substantially planar face portion disposed perpendicular to said axis of said respective first and second shafts with said recesses being formed in said face portion of each collar to extend substantially radially with respect to said axis of said respective shafts with a selected angular spacing between each said recess, each clutch member having a substantially planar face portion extending parallel to said face portion on a said collar, said key means of said clutch members comprising a plurality of raised teeth formed on said face portion of each said clutch member corresponding to the number of recesses on said face portion of each said collar, said teeth being of a size and disposition to fit into said recesses, said collar means on said third and forth rotatable members each comprising a collar having a free end and a bore, said collars being fixed on an end of said respective third and fourth shafts, said power transmitting portion comprising surface sections in said bores, said surface sections being flat surface lying on chords extending substantially perpendicular to said axes of said respective third and fourth shafts, each said clutch member having a tubular section having a free end and extending along a said common axis into a said bore of an associated collar on said respective third and fourth shafts, each said tubular section having an exterior surface at said free end thereof, said exterior surface of each said tubular member having flat surface portions which engage said flat surfaces in said bores of said collars on said respective third and fourth shafts.

13. The apparatus as claimed in claim 1 wherein said retaining means includes first movable latch means for holding said first coupling means in said coupled position and second movable latch means for holding said second coupling means in said coupled position, first signal controlled means for operating said first latch means and second signal controlled means for operating said second latch means, means for generating and delivering signals to said first and second signal controlled means.

14. The apparatus as claimed in claim 13 wherein said means for generating and delivering signals to said first and second signal controlled means includes means for reading a program.

15. The apparatus as claimed in claim 14 wherein said means for reading a program comprises electrical sensing means for sensing perforations in a perforated tape.

16. The apparatus as claimed in claim 13 wherein said first and second signal controlled means are each electrically energizable solenoids.

* * * * *